US008025746B2

(12) United States Patent
Kawanaka et al.

(10) Patent No.: US 8,025,746 B2
(45) **Date of Patent: *Sep. 27, 2011**

(54) TURBINE CASING

(75) Inventors: Hirotsugu Kawanaka, Hitachi (JP); Masahiko Arai, Hitachinaka (JP); Tateki Nakamura, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 749 days.

This patent is subject to a terminal disclaimer.

(21) Appl. No.: 11/689,546

(22) Filed: Mar. 22, 2007

(65) Prior Publication Data

US 2007/0224041 A1 Sep. 27, 2007

(30) Foreign Application Priority Data

Mar. 23, 2006 (JP) ..... 2006-079906

(51) Int. Cl.
*C22C 38/54* (2006.01)
*C22C 38/46* (2006.01)
*C22C 38/50* (2006.01)

(52) U.S. Cl. ..... 148/335; 148/330; 420/106; 420/109

(58) Field of Classification Search ..... 148/335, 148/330; 420/106, 109; 419/241 R
See application file for complete search history.

(56) References Cited

U.S. PATENT DOCUMENTS 6,574,966 B2 * 6/2003 Hidaka et al. ..... 60/806
7,540,711 B2 * 6/2009 Arai et al. ..... 415/216.1

FOREIGN PATENT DOCUMENTS

| | | |
|---|---|---|
| JP | 354107416 | * 8/1979 |
| JP | 360258451 | * 12/1985 |
| JP | 8-209293 | 8/1996 |
| JP | 10-259449 | 9/1998 |
| JP | 2000-273570 | 10/2000 |
| JP | 2001-059130 | 3/2001 |
| JP | 2001-115230 | 4/2001 |

OTHER PUBLICATIONS

Metals Handbook Desk Edition, second edition, "Effects of Alloying Elements" , Mechanical Properties of carbon and alloy steels, pp. 220-221, 1998.*

* cited by examiner

*Primary Examiner* — Deborah Yee
(74) *Attorney, Agent, or Firm* — Mattingly & Malur, P.C.

(57) ABSTRACT

A casing is formed from an alloy which contains, by mass, 0.08-0.20% C, 0.05-0.45% Si, 0.10-0.30% Mn, 0.80-1.40% Ni, 1.00-1.40% Cr, 1.20-1.60% Mo, 0.10-0.30% V, 0.06-0.10% Ti, 0.0005-0.0010% B, not more than 0.01% P, not more than 0.01% S, and not more than 0.005% Al, the balance being Fe and unavoidable impurity elements. The casing has excellent high-temperature strength, high toughness and excellent weldability, and is applicable to casings used in high-temperature high-pressure steam environments.

15 Claims, 8 Drawing Sheets

TURBINE CASING

BACKGROUND OF THE INVENTION

1. Field of the Invention

The present invention relates to a turbine casing and a valve casing, and particularly to a turbine casing or valve casing to be used for a steam turbine.

2. Description of the Related Art

Turbine casings and valve casings used in steam turbines for thermal power generation are complicated in their shape and, therefore, they are fabricated by use of cast steels in many cases. These high-temperature members are required to be high in high-temperature strength and creep rupture strength. Further, where a cast steel is used, these members are required to have excellent weldability, because of the need to repair their defective portions by welding.

In order to meet these requirements, there have come to be used casing materials which are high in strength and excellent in weldability, such as the casing material disclosed in JP-A-1996-209293.

Other than the just-mentioned material, there are known the 2.25Cr-2W—Mo—V cast steels to be used as an alternative to high-Cr heat resisting steels, such as those described in JP-A-2001-115230 and JP-A-2001-059130, and the Cr—Mo—V—W cast steels enhanced in weldability through improvement of impact resistance property, such as those described in JP-A-2000-273570 and JP-A-1998-259449.

SUMMARY OF THE INVENTION

However, the thermal electric power stations in recent years are demanded to have both high thermal efficiency and excellent economy. The casing material used for steam turbines, which have hitherto been used, cannot necessarily be said to be satisfactory for meeting the demand.

Accordingly, it is an object of the present invention to provide a casing which has excellent high-temperature strength, high toughness and excellent weldability and which is preferably applicable as a casing material to be used in high-temperature high-pressure steam environments.

According to the present invention, there is provided a casing material which is formed from an alloy containing, by mass, 0.08-0.20% C, 0.05-0.45% Si, 0.10-0.30% Mn, 0.80-1.40% Ni, 1.00-1.40% Cr, 1.20-1.60% Mo, 0.10-0.30% V, 0.06-0.10% Ti, 0.0005-0.0010% B, not more than 0.01% P, not more than 0.01% S, and not more than 0.005% Al, the balance being Fe and unavoidable impurity elements.

Besides, according to the present invention, there is also provided a casing material which is formed from an alloy containing, by mass, 0.08-0.20% C, 0.05-0.45% Si, 0.10-0.30% Mn, 1.10-1.40% Ni, 1.00-1.40% Cr, 1.20-1.60% Mo, 0.10-0.30% V, 0.06-0.10% Ti, 0.0005-0.0010% B, not more than 0.01% P, not more than 0.01% S, and not more than 0.005% Al, the balance being Fe and unavoidable impurity elements.

These casing materials are used for turbine casings of turbines and valve casings for valves. In addition, these casing materials are preferably cast steels.

Besides, the turbine casings and valve casings are for use in steam turbines.

Furthermore, in the casing materials, preferably, the content ratio of Mn/Ni is not more than 1.0, more preferably not more than 0.5, further preferably in the range of 0.07-0.38, and still further preferably 0.07-0.27, and the content ratio of (Mo+V)/Ni is not more than 3.0, more preferably in the range of 0.93-2.38, and further preferably 0.93-1.73.

In addition, in the casing materials, the content ratio of (Mo+V)/Ni/B is in the range of 1000-5000, preferably 3500-5000.

According to the present invention, it is possible to provide a casing having excellent high-temperature strength, high toughness and excellent weldability, as a casing material to be used in high-temperature high-pressure steam environments.

DETAILED DESCRIPTION OF THE PREFERRED EMBODIMENTS

Figure 1:
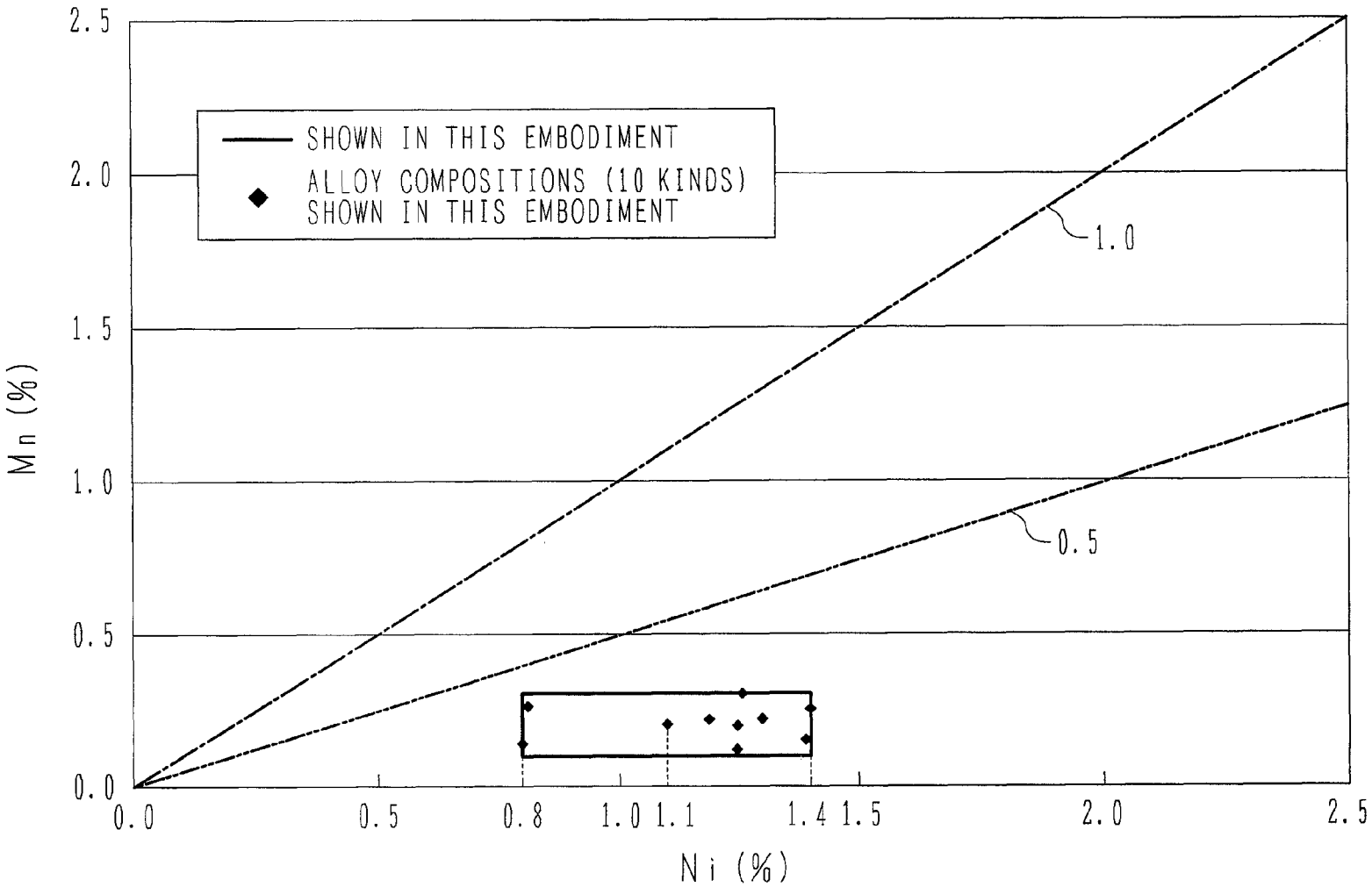
FIG. 1 is a diagram showing the balance between Mn and Ni in alloys shown in an embodiment of the present invention.

Now, the present invention will be described more in detail below referring to an embodiment thereof.

A turbine casing and a valve casing for use in steam turbines which will be described in this embodiment are each formed from an alloy containing, by mass, 0.08-0.20% C, 0.05-0.45% Si, 0.10-0.30% Mn, 0.80-1.40% Ni, 1.00-1.40% Cr, 1.20-1.60% Mo, 0.10-0.30% V, 0.06-0.10% Ti, 0.0005-0.0010% B, not more than 0.01% P, not more than 0.01% S, and not more than 0.005% Al, the balance being Fe and unavoidable impurity elements.

Incidentally, the content of Ni is preferably in the range of 1.10-1.40%.

Besides, recently, it has come to be a frequent practice to repeat starting and stopping of the operation of a steam turbine instead of operating the turbine steadily. Therefore, it is necessary to reduce the thermal stress generated attendant on the start and stop of the steam turbine.

By realizing a casing having such a material composition as above-mentioned, it is possible to provide a steam turbine having a turbine casing and a valve casing having excellent characteristics under the stress conditions at the times of start and stop of the steam turbine and being excellent in weldability and fabricability.

The casing with the above material composition has been enhanced in mechanical properties and is excellent in economy. Besides, a heat resisting steel having excellent high-temperature strength as well as high toughness and excellent weldability can be realized.

The casing described in the present embodiment does not contain large amounts of Cr, W, Nb as strengthening elements, and, therefore, lowerings in weldability, fabricability and castability of the casing can be obviated. In addition, the casing can be used stably even in supercritical environments, and shows sufficient strength and toughness.

In particular, for weldability, it is possible to realize a heat resisting steel lowered in the sensitivity to crack (SR crack) generated in the heat affected zone (HAZ), without any stress relief treatment after welding.

In addition, there are many properties which are required of the steam turbine casings. Of the required properties, characteristic are fabricability of large-sized products, toughness, and weldability. Therefore, the materials for boiler piping or rotors cannot be diverted to material for the casings. In other words, the designing of material composition of a low-alloyed heat resisting steel varies depending on the intended use of the heat resisting steel.

In particular, the materials for turbine casing and valve casing are used in the high pressure and intermediate pressure sections in a supercritical pressure turbine subjected to a main steam temperature of not less than 566° C. and a main steam pressure of not less than 24 MPa, i.e., a casing material having a high creep rupture strength at temperatures of not less than 566° C. and being excellent in toughness and weldability. Original research and development are indispensably needed for such materials.

<Grounds for Composition Limits>

Carbon (C) is an element necessary for enhancing high-temperature strength, and a C content of not less than 0.05% is needed. If the C content exceeds 0.25%, exposure of the material to high temperatures for a long time leads to enbrittlement due to excessive precipitation of carbides or the like and to a lowering in creep rupture strength, and crack sensitivity at welded parts is increased. Therefore, the content of C is limited to or below 0.25%. In particular, for obtaining high strength and toughness, the C content is preferably in the range of 0.08-0.20%.

Silicon (Si) is generally added as a deoxidizing agent, and increases hardenability. However, excess Si would raises temper brittleness sensitivity. Therefore, the Si content must be set in the range of 0.05-0.75%. Preferably, the upper limit of Si content is 0.45%, and more preferably, the upper limit is 0.40%.

Manganese (Mn) is added as a deoxidizing agent, like Si, increases hardenability and enhances strength and toughness. However, excess Mn would increase temper brittleness sensitivity, and would lower creep rupture strength. An insufficient Mn content, on the other hand, would lower creep rupture ductility and castability. In the case of combined addition of Mn with Ni for the purpose of enhancing toughness and creep rupture strength, the Mn content is preferably 0.10-0.30%, more preferably 0.10-0.25%.

Nickel (Ni) is an effective element for enhancing toughness. However, addition of Ni lowers creep rupture strength. In CrMoV composition alloys in the past, therefore, the Ni content has been generally limited to or below 0.50% in many cases. As a result of their researches, the present inventors have found out that where the Mn content is set in the range of 0.10-0.30%, the Ni content can be increased to thereby enhance toughness, while maintaining creep rupture strength. It has been also found that in the case of a use temperature of 566° C., it is preferable to set the Ni content in the range of 0.80-1.40% in the condition where Mn content is 0.10-0.30%. Where a higher toughness is demanded, the Ni content is preferably 1.10-1.40%, and in this case, the Mn content is preferably 0.10-0.30%, more preferably 0.10-0.25%.

Chromium (Cr) is a carbide forming element which enhances high-temperature strength and oxidation resistance; thus, Cr is an indispensable element in high-temperature materials. Therefore, Cr must be contained in an amount of not less than 0.50%. If the Cr content exceeds 2.00%, however, coarsening of precipitates would occur upon heating to high temperatures for a long time, resulting in a lowered creep rupture strength. In particular, for obtaining a high creep rupture strength, the Cr content is preferably 1.00-1.40%.

Molybdenum (Mo) enhances creep rupture strength through solution strengthening and precipitation strengthening, and, further, prevents temper embrittlement. If the Mo content is less than 0.50%, a sufficient strength cannot be obtained. On the other hand, when the Mo content exceeds 2.00%, its effect is not increased accordingly. In particular, for obtaining a high creep rupture strength, the Mo content is preferably 1.20-1.60.

Vanadium (V) combines with C to form a carbide, thereby enhancing creep rupture strength. Where the V content is less than 0.05%, a sufficient strength cannot be obtained. On the other hand, if V content exceeds 0.50%, SR crack sensitivity after welding is raised, which must be obviated. In particular, for obtaining high creep rupture strength and ductility, the V content is preferably 0.10-0.30%.

Boron (B) enhances hardenability, and enhances creep rupture strength remarkably. Where the B content is less than 0.0003%, a sufficient strength cannot be obtained. On the other hand, if the B content exceeds 0.0030%, SR crack sensitivity after welding is increased conspicuously, which must be obviated. In particular, for obtaining a high creep rupture strength and suppress the SR crack sensitivity after welding to a low level, the B content is preferably 0.0005-0.0010%.

Titanium (Ti), like Si, is added as a deoxidizing agent. Where the Ti content exceeds 0.15%, the sensitivity to enbrittlement upon heating to high temperatures for a long time would be raised, which must be obviated. Thus, the Ti content is preferably 0.06-0.10%.

Aluminum (Al), like Si, is effective as a deoxidizing agent. From the results of their research on CrMoV composition cast steels, the present inventors have found out that Al lowers creep rupture strength and creep rupture ductility, and raises SR crack sensitivity after welding. In this embodiment, the Al content is preferably not more than 0.005%. The lower limit of the Al content is preferably 0%, if possible.

Phosphorus (P) and sulfur (S) are impurity elements which might cause temper brittleness, and, therefore, their contents are desirably as low as possible. However, it is difficult to completely exclude P and S. In this embodiment, the P and S contents are desirably not more than 0.01%. The lower limits of the P and S contents are preferably 0%.

<Other Elements>

Incidentally, among the elements which are not added in the present embodiment, W and Nb and N which have been confirmed to be generally added in the cases of low-alloyed heat resisting steels will be described below. In terms of their characteristics and the reasons why the addition thereof is obviated in this embodiment.

Tungsten (W), like Mo, enhances creep rupture strength through solution strengthening and precipitation strengthening, and its effect is greater at a higher temperature. However, the presence of W tends to lower ductility, toughness and weldability, and lowers castability.

Niobium (Nb) combines with C to form a carbide, thereby enhancing high-temperature strength. However, the presence of Nb lowers weldability and castability. Besides, Nb contained in low-alloyed heat resisting steels does not have such a level of strength-enhancing effect as seen in the cases of highly alloyed heat resisting steels, for example, high-Cr steels.

Nitrogen (N) is rather a deleterious element in the present embodiment. Since N combines with B to cause precipitation of BN, the amount of solid solution of B is reduced, so that hardenability secured by B is lowered, and the effect of B on enhancing creep rupture strength is reduced. Further, the presence of N lowers toughness and weldability.

<Design of Material Composition>

To strengthen the casing material, a good balance between creep rupture strength and toughness is necessary.

It is a commonly recognized practice to add W, Nb and N as strengthening agents for CrMoV composition cast steels. However, these elements are not used in the present embodiment, from the viewpoints of weldability, toughness and castability.

The fundamental idea relating to the casing material described in the present embodiment lies in that creep rupture strength is augmented by Mo, V and B, and toughness is secured by Ni, the contents of these elements being as above-mentioned.

However, in order to positively establish this idea, it is necessary to retain the creep rupture strength, which is lowered as the Ni content increases, at or above a predetermined value. For this purpose, it is necessary to set the Mn content at an appropriate level and to reduce the contents of the impurity elements which would lower toughness and weldability, such as P, S, and Al.

In consideration of these points, the compositional balance between Mn and Ni and the compositional balance between high-temperature strength enhancing elements and toughness enhancing elements, for securing a good balance between creep rupture strength and toughness, are incorporated in the design of composition.

The relationship between Mn and Ni is such that, as shown in FIG. 1, such a design as to positively add Ni is adopted, and the Ni content is set to be higher than the Mn content. It has been found out that the preferable Mn content range is 0.1-0.3%, and the preferable Ni content is 0.8-1.4%; when this is expressed in terms of Mn/Ni, the range of Mn/Ni is 0.07-0.32. Besides, where a higher toughness is demanded, the Ni content is set in the range of 1.1-1.4%. In this case, Mn/Ni is 0.07-0.27%. The widest Mn/Ni range is 0.05-0.50%.

Incidentally, FIG. 1 shows the plots for 10 kinds of alloy compositions shown in this embodiment (sample Nos. 1-3 and Nos. 7-13 given in Table 1 below).

In order to attain a good balance between creep rupture strength and toughness, the compositional relationship between high-temperature strength enhancing elements and toughness enhancing element is important.

Figure 2:
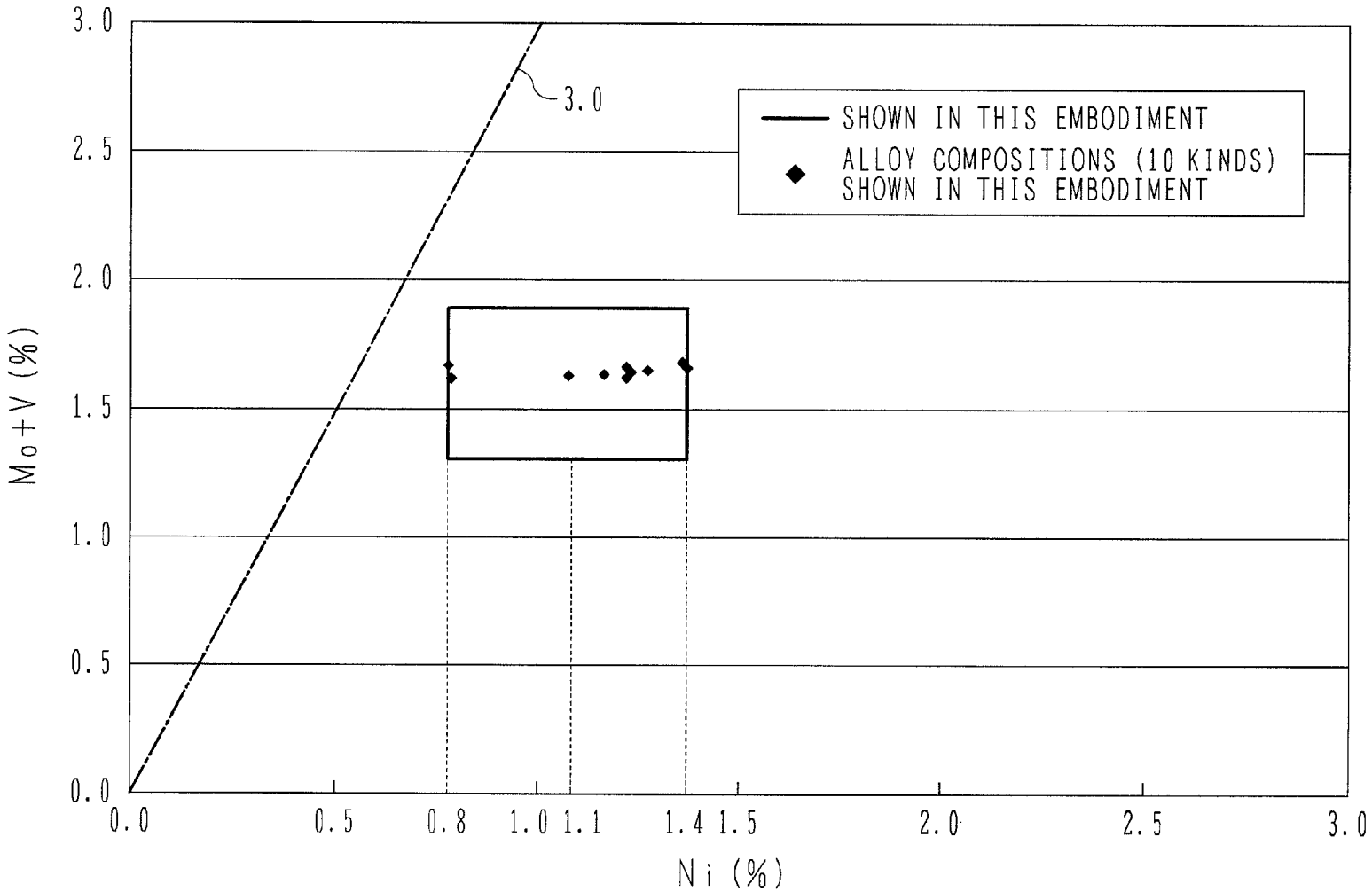
FIG. 2 is a diagram showing the balance between high-temperature strength enhancing elements and a toughness enhancing element in the alloys shown in the embodiment.

The compositional relationship between Mo, V, B serving as high-temperature strength enhancing elements and Ni serving as a toughness enhancing element is important, and the relationship between Mo+V and Ni is shown in FIG. 2. As shown in FIG. 2, the range of (Mo+V)/Ni shown in this embodiment is in the region on the lower side of the straight line with a gradient of 3 in the diagram, and (Mo+V)/Ni is preferably 0.93-2.83. Further, where the Ni content is 1.1-1.4, (Mo+V)/Ni is preferably 0.93-1.73. Incidentally, the widest range of (Mo+V)/Ni is 0.71-3.16.

Figure 3:
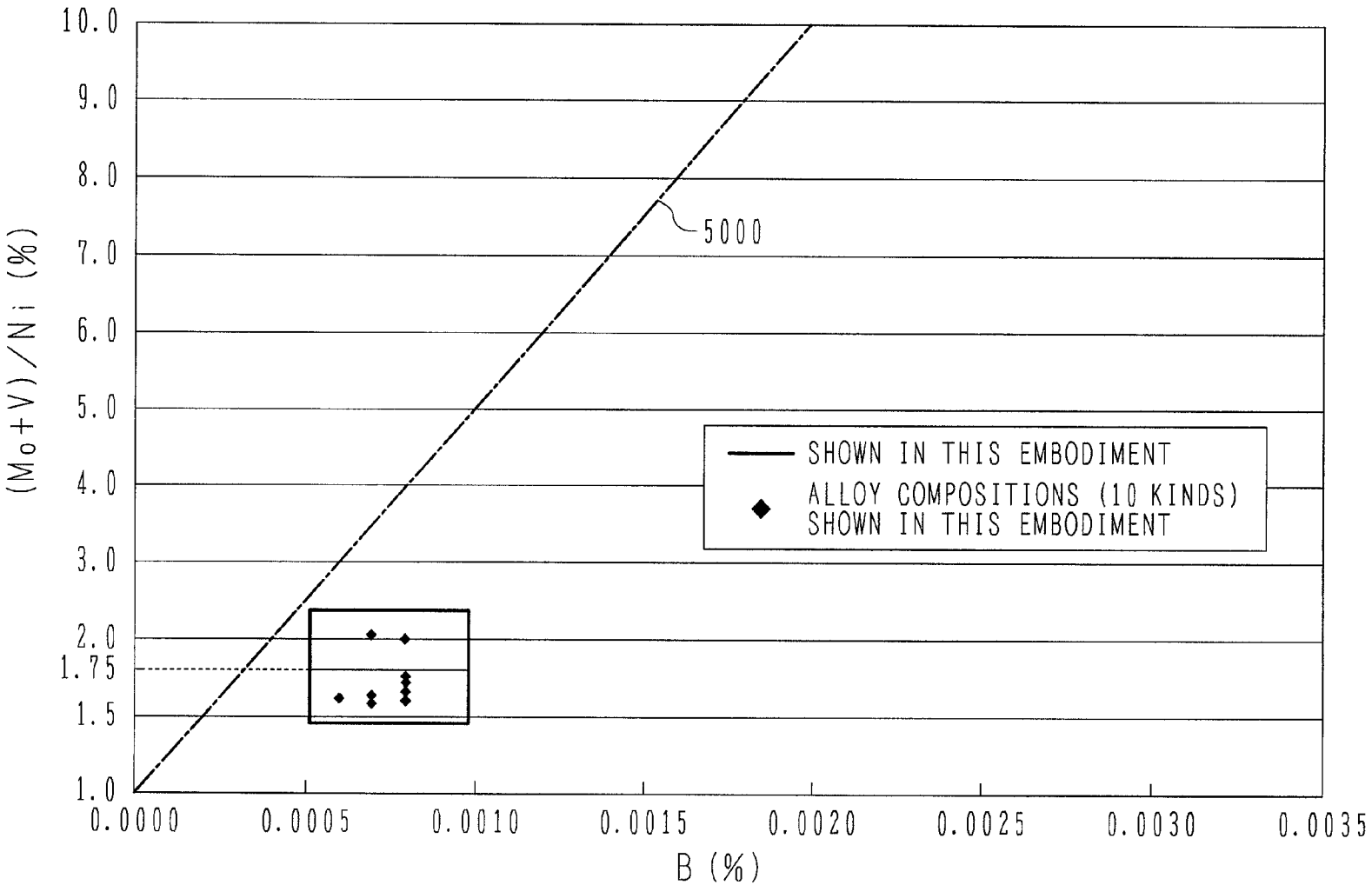
FIG. 3 is a diagram showing the balance between the content radio of the high-temperature strength enhancing elements to the toughness enhancing element and B in the alloys shown in the embodiment.

The relationship between B, which is an indispensable element for enhancing creep rupture strength in this embodiment, and (Mo+V)/Ni is shown in FIG. 3.

It is seen that, when the content of B is expressed in ppm, the preferable range in this embodiment is in the region on the lower side of the straight line with a gradient of 0.5 in the diagram. Incidentally, (Mo+V)/Ni/B is preferably in the range of 1000-5000. Where the Ni content is 1.1-1.4%, (Mo+V)/Ni/B is preferably 3500-5000. Besides, the widest range of (Mo+V)/Ni/B is 200-5000.

In FIGS. 2 and 3, also, the plots for the 10 alloy compositions shown in this embodiment (sample Nos. 1-3 and sample Nos. 7-13) are shown.

<Heat Treatment>

For heat treatment, quenching (hardening) or normalizing is conducted, and then tempering is conducted.

The quenching (hardening) or normalizing treatment is preferably carried out by holding at a temperature of 1000-1100° C. and conducting forced cooling. The tempering treatment is preferably performed by holding at a temperature of 680-750° C., followed by slow cooling. Repetition of the tempering treatment twice or more leads to an enhanced toughness. Furthermore, it is preferable to repeat twice the process of quenching (hardening) or normalizing treatment and tempering treatment.

In the present embodiment, it is preferable to obtain a fully tempered bainite structure, whereby a steel high in high-temperature strength can be obtained.

<Welding>

For welding conditions and repairing conditions in the present invention, it is desirable that welding be conducted with a preheating temperature of not less than 150° C., and a stress relief heat treatment is conducted at a temperature of not less than 150° C. during the cooling process after welding. The stress relief treatment after welding is desirably carried out by holding at a temperature of 650-700° C. for a period of not less than 1 hr. In addition, when the stress relief treatment after welding is repeated, the notch toughness at the welding heat affected zone is enhanced, whereby the residual stress in the welded portion can be further lowered.

Arc welding process such as TIG welding and MIC welding is applied as the welding process.

A Cr—Mo based electrode is desirably used as the electrode (welding rod). Besides, in the case where a quenching (annealing) and tempering treatment after the welding is required, a Cr—Mo—V based electrode is desirably used, for securing the creep rupture strength.

EXAMPLE 1

The materials described in the present embodiment were melted in a high-frequency induction melting furnace, and the melts were cast in molds, to obtain ingots. The shape of specimens was 300 mm in width by 160 mm in height by 80 mm in depth.

In heat treatments, each specimen was held at 1050° C. for 5 hr and cooled at a rate of 400° C./hr as a normalizing treatment, and was then held at 725° C. for 12 hr and cooled in furnace as a tempering treatment.

Table 1 shows the chemical compositions of the samples served to the tests described later.

TABLE 1

| Sample No. | Chemical composition (mass %) C | Si | Mn | P | S | Ni | Cr | Mo | V | Ti | B | Al | (Mo + V)/ Ni | P + S + Al (ppm) |
|---|---|---|---|---|---|---|---|---|---|---|---|---|---|---|
| 1 | 0.10 | 0.15 | 0.20 | 0.003 | 0.007 | 1.10 | 1.22 | 1.38 | 0.25 | 0.08 | 0.0008 | 0.003 | 1.48 | 130 |
| 2 | 0.11 | 0.16 | 0.22 | 0.003 | 0.007 | 1.19 | 1.23 | 1.40 | 0.24 | 0.08 | 0.0008 | 0.003 | 1.38 | 130 |
| 3 | 0.11 | 0.17 | 0.21 | 0.002 | 0.007 | 1.30 | 1.21 | 1.40 | 0.25 | 0.08 | 0.0007 | 0.004 | 1.27 | 130 |
| 4 | 0.10 | 0.18 | 0.21 | 0.003 | 0.008 | 1.52 | 1.22 | 1.41 | 0.25 | 0.08 | 0.0008 | 0.003 | 1.09 | 140 |
| 5 | 0.12 | 0.19 | 0.21 | 0.003 | 0.007 | 1.65 | 1.21 | 1.39 | 0.26 | 0.08 | 0.0007 | 0.002 | 1.00 | 120 |
| 6 | 0.11 | 0.18 | 0.05 | 0.003 | 0.007 | 1.24 | 1.20 | 1.39 | 0.24 | 0.08 | 0.0006 | 0.003 | 1.31 | 130 |
| 7 | 0.09 | 0.15 | 0.12 | 0.003 | 0.006 | 1.25 | 1.23 | 1.38 | 0.24 | 0.08 | 0.0008 | 0.003 | 1.30 | 120 |
| 8 | 0.10 | 0.15 | 0.20 | 0.003 | 0.008 | 1.25 | 1.21 | 1.41 | 0.25 | 0.07 | 0.0007 | 0.005 | 1.33 | 160 |
| 9 | 0.10 | 0.18 | 0.29 | 0.003 | 0.009 | 1.26 | 1.20 | 1.41 | 0.24 | 0.08 | 0.0006 | 0.003 | 1.31 | 150 |
| 10 | 0.12 | 0.14 | 0.15 | 0.003 | 0.007 | 1.39 | 1.20 | 1.43 | 0.25 | 0.09 | 0.0007 | 0.003 | 1.21 | 130 |
| 11 | 0.11 | 0.17 | 0.25 | 0.003 | 0.007 | 1.40 | 1.22 | 1.40 | 0.26 | 0.08 | 0.0008 | 0.004 | 1.19 | 140 |
| 12 | 0.10 | 0.18 | 0.14 | 0.003 | 0.007 | 0.80 | 1.21 | 1.42 | 0.25 | 0.08 | 0.0007 | 0.003 | 2.09 | 130 |
| 13 | 0.09 | 0.14 | 0.26 | 0.003 | 0.007 | 0.81 | 1.23 | 1.38 | 0.25 | 0.08 | 0.0008 | 0.003 | 2.01 | 130 |
| 14 | 0.10 | 0.15 | 0.21 | 0.003 | 0.006 | 1.25 | 1.20 | 1.39 | 0.25 | 0.08 | 0.0008 | 0.023 | 1.31 | 320 |
| 15 | 0.11 | 0.16 | 0.20 | 0.002 | 0.008 | 1.24 | 1.20 | 1.40 | 0.24 | 0.07 | — | 0.003 | 1.32 | 130 |
| 16 | 0.11 | 0.15 | 0.19 | 0.003 | 0.007 | 2.00 | 1.20 | 1.39 | 0.25 | 0.08 | 0.0007 | 0.003 | 0.82 | 130 |
| 17 | 0.10 | 0.16 | 0.21 | 0.003 | 0.008 | 0.50 | 1.21 | 1.43 | 0.25 | 0.06 | 0.0007 | 0.004 | 3.36 | 150 |
| 18 | 0.12 | 0.23 | 1.20 | 0.003 | 0.007 | 1.00 | 1.20 | 1.39 | 0.26 | 0.08 | 0.0008 | 0.005 | 1.65 | 150 |

Every one of the compositions of the samples had a uniform fully tempered bainite structure. Sample Nos. 1-3 and Sample Nos. 7-13 are steels in the present embodiment, while Sample Nos. 4-6 and Sample Nos. 14-18 are steels of reference examples produced for comparison.

Creep rupture tests were conducted by use of creep test specimens having a parallel portion diameter of 6 mm and a parallel portion length of 30 mm. Impact tests were carried out by use of V-notched specimens.

Welding heat affected zone crack testes were conducted by use of y-grooved specimens (plate thickness: 20 mm). Welding was conducted by use of a Cr—Mo steel covered electrode (diameter: 4 mm) having the composition shown in Table 2 below. Specifically, after preheating to 250° C., one-pass welding was conducted under the conditions set forth in Table 3 below. Thereafter, the vicinity of the welded portion of each specimen was subjected to a stress relief treatment by annealing at 690° C. for 2 hr, with a welding heat affected zone starting temperature of 200° C.

TABLE 2

| C | Si | Mn | P | S | Cr | Mo | V | Cu | Ni | Sb | Sn | As |
|---|---|---|---|---|---|---|---|---|---|---|---|---|
| 0.03 | 0.69 | 0.63 | 0.005 | 0.008 | 1.98 | 0.87 | — | — | — | 0.004 | 0.0052 | 0.004 |

TABLE 3

| | |
|---|---|
| Current | 170 A |
| Voltage | 22 V |
| Welding rate | 110 mm/min |
| Preheating temperature | 250° C. |
| SR starting temperature | 200° C. |
| After-treatment conditions | 690° C. × 2 h |

Figure 4:
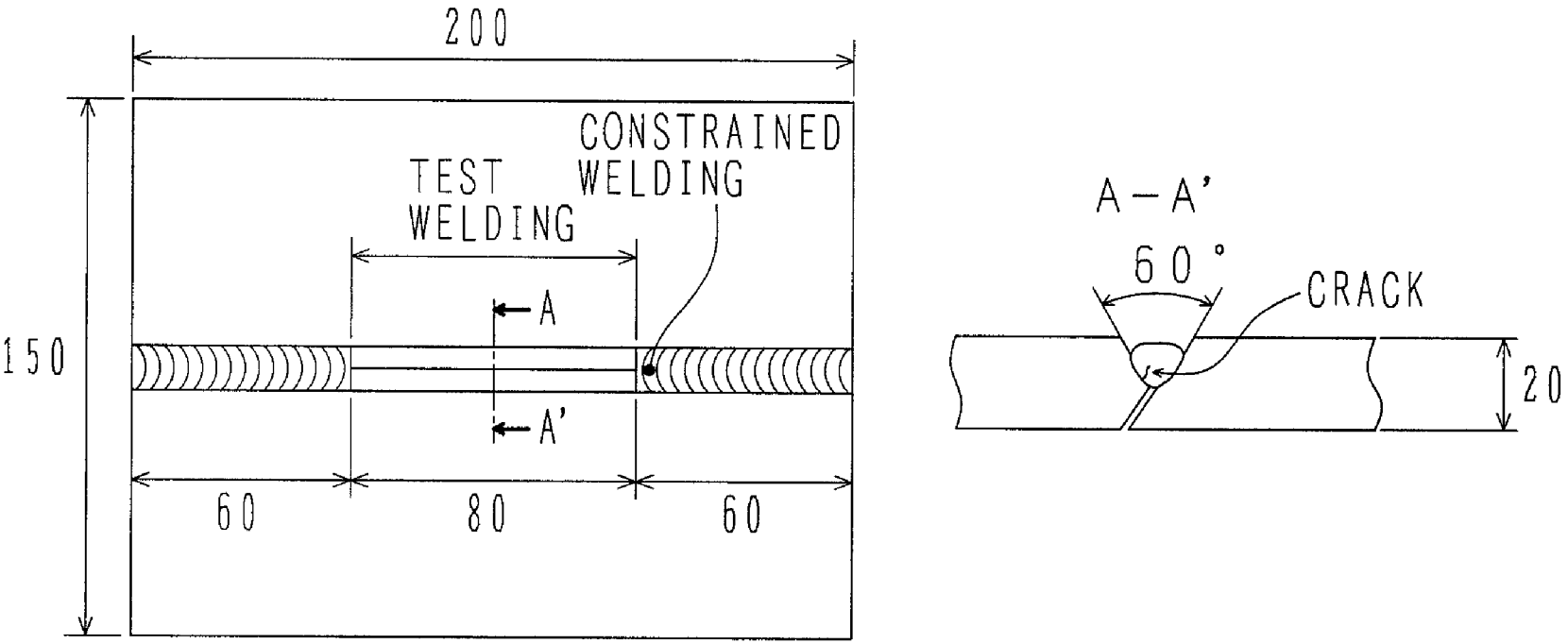
FIG. 4 is a structural diagram of a welding SR crack test specimen.

FIG. 4 shows a structural diagram of a specimen for the welding heat affected zone crack test.

Table 4 shows fracture appearance transition temperature (FATT), creep rupture strength (566° C.×100,000 hr strength), and the presence or absence of welding SR crack, for the alloys shown in Table 1 above.

TABLE 4

| Sample No. | 566° C. × 100,000 hr strength (Mpa) | FATT (° C.) | Welding SR crack (present/absent) |
|---|---|---|---|
| 1 | 136.7 | 103 | Absent |
| 2 | 134.0 | 93 | Absent |
| 3 | 130.7 | 83 | Absent |
| 4 | 117.3 | 65 | Absent |
| 5 | 97.2 | 62 | Absent |
| 6 | 121.9 | 93 | Absent |
| 7 | 132.0 | 83 | Absent |
| 8 | 132.7 | 85 | Absent |
| 9 | 132.0 | 84 | Absent |
| 10 | 124.0 | 75 | Absent |
| 11 | 122.6 | 74 | Absent |
| 12 | 134.7 | 120 | Absent |
| 13 | 136.0 | 122 | Absent |
| 14 | 98.5 | 114 | Present |
| 15 | 100.5 | 80 | Absent |
| 16 | 36.9 | 52 | Absent |

TABLE 4-continued

| Sample No. | 566° C. × 100,000 hr strength (Mpa) | FATT (° C.) | Welding SR crack (present/absent) |
|---|---|---|---|
| 17 | 134.7 | 134 | Absent |
| 18 | 33.5 | 124 | Absent |

From Table 4, it is seen that every one of Sample Nos. 1-3 and Sample Nos. 7-13 according to this embodiment exhibited good results as to fracture appearance transition temperature (FATT), creep rupture strength (566° C.×100,000 hr strength) and the presence/absence of welding SR crack.

Figure 5:
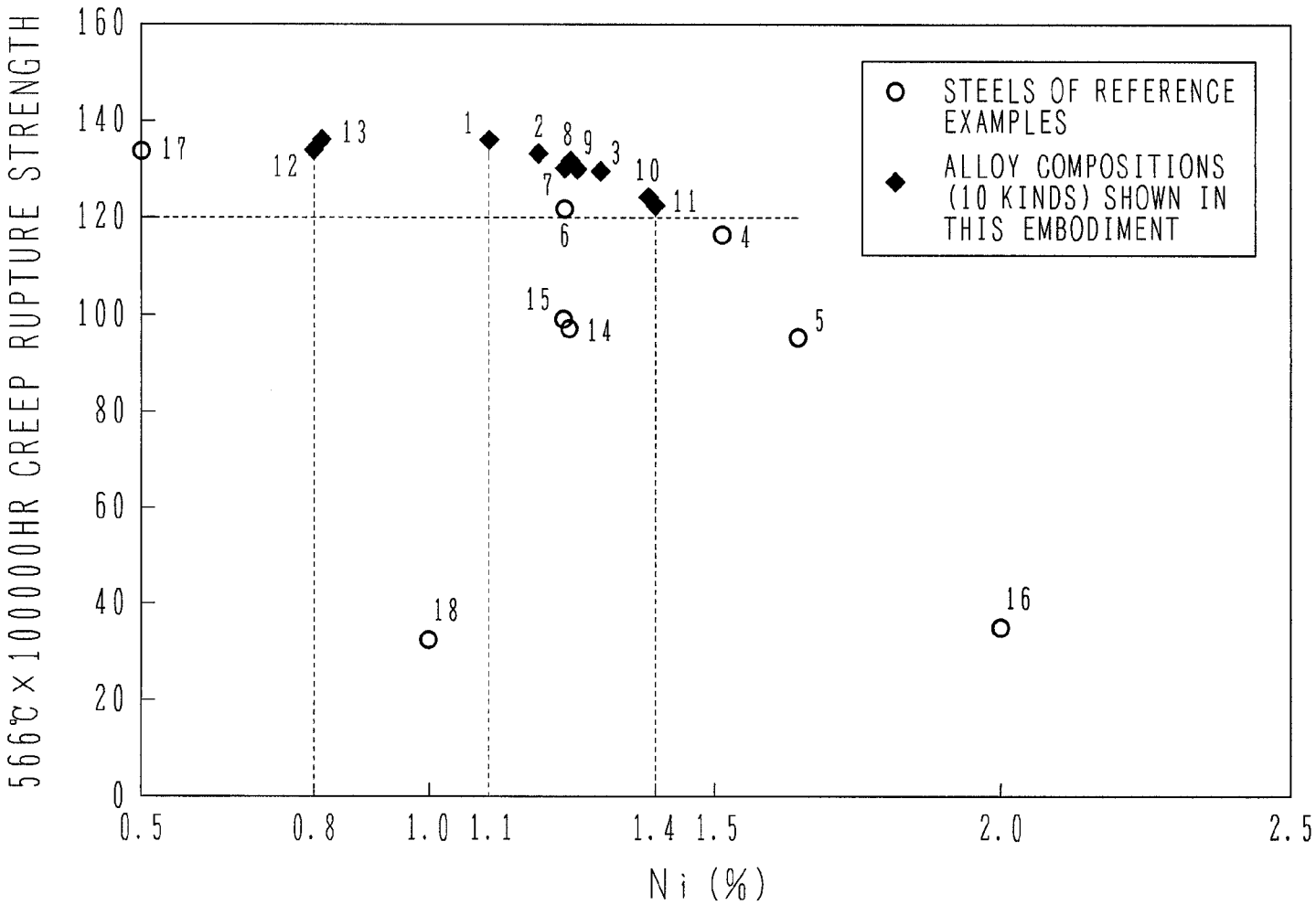
FIG. 5 is a diagram showing the relationship between Ni content and 566° C.×100,000 hr creep rupture strength.
Figure 6:
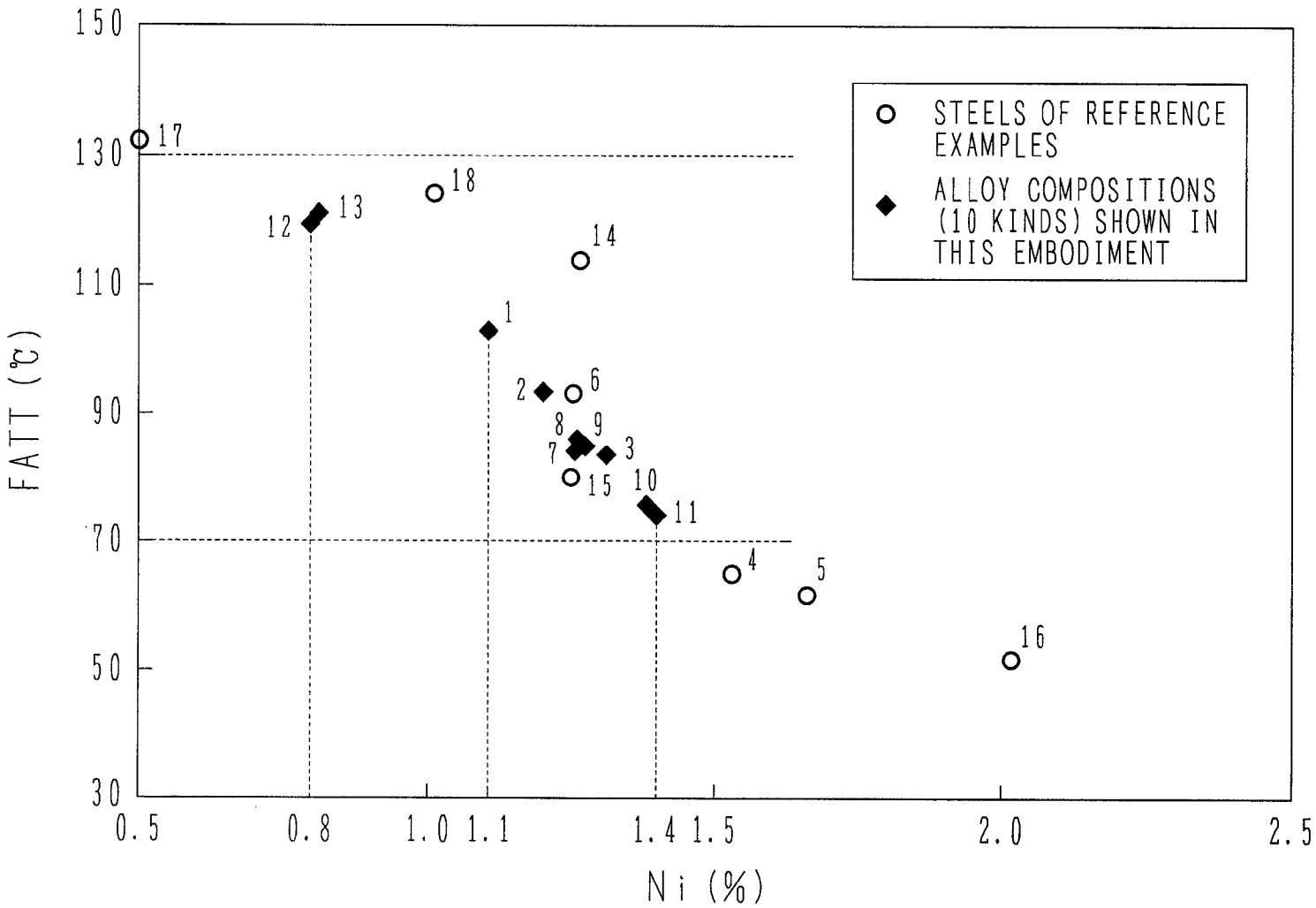
FIG. 6 is a diagram showing the relationship between Ni content and fracture appearance transition temperature (FATT)

FIG. 5 shows the relationship between Ni content and 566° C.×100,000 hr creep rupture strength, and FIG. 6 shows the relationship between Ni content and fracture appearance transition temperature (FATT).

From FIGS. 5 and 6, also, it is seen that all of Sample Nos. 1-3 and Sample Nos. 7-13 according to this embodiment are good in fracture appearance transition temperature (FATT) and creep rupture strength (566° C.×100,000 hr strength).

Thus, as a result of examination of the influences of Ni content on mechanical properties, it has been found that an increase in the Ni content lowers creep rupture strength and enhances toughness.

EXAMPLE 2

Figure 7:
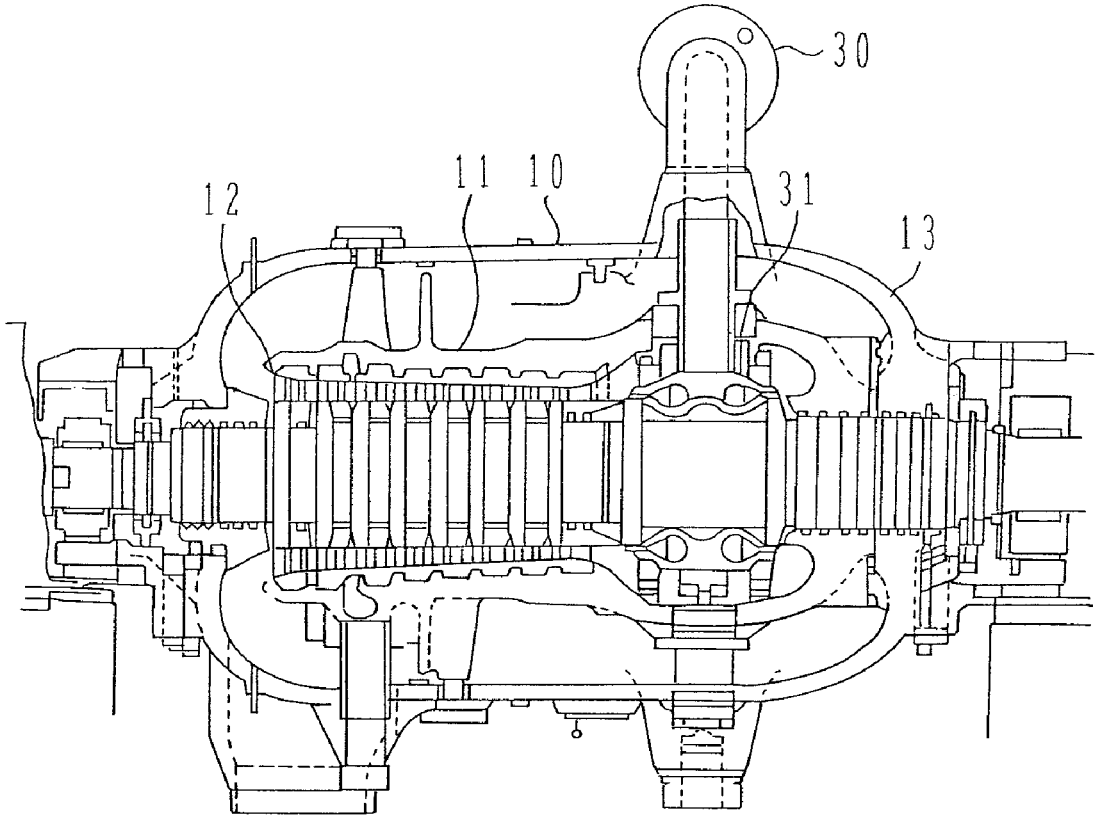
FIG. 7 is a structural sectional view of a high pressure steam turbine.
Figure 8:
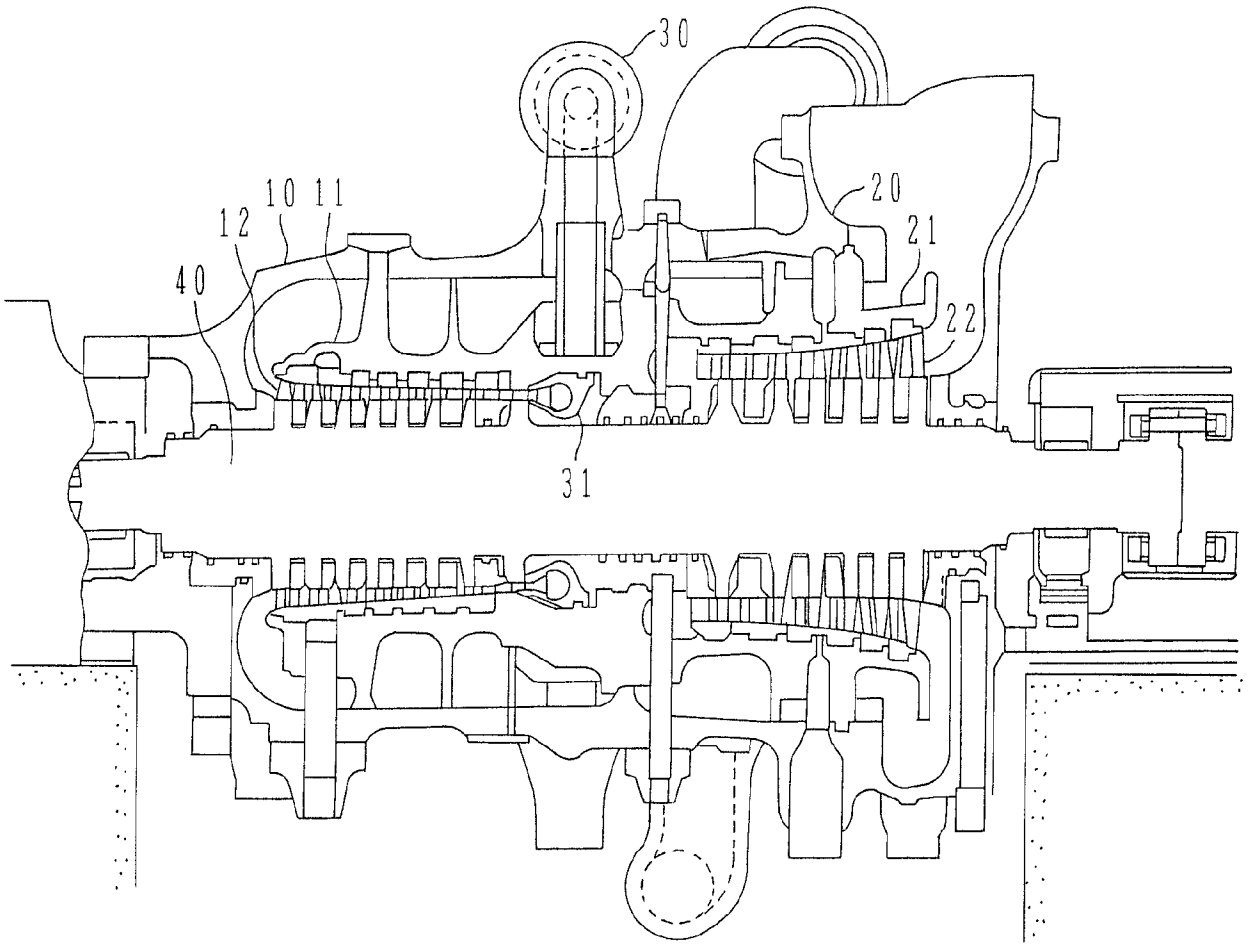
FIG. 8 is a structural sectional view of a high/intermediate pressure integrated type steam turbine.

FIGS. 7 and 8 are schematic sectional views of high-pressure steam turbines fabricated by use of the high-strength heat resisting steel shown in the present embodiment. Incidentally, the steam turbine shown in FIG. 7 is a high pressure steam turbine, while the steam turbine shown in FIG. 8 is a high/intermediate pressure integrated type steam turbine.

As shown in FIG. 7, the high pressure steam turbine includes a high pressure outer casing 10, a high pressure inner casing 11 inside thereof, and a high pressure rotor shaft 13 which has high pressure rotor blades 12 rooted thereto and which is disposed inside the high pressure inner casing 11.

In addition, as shown in FIG. 8, the high/intermediate pressure integrated type steam turbine includes, on the high pressure side, a high pressure outer casing 10, a high pressure inner casing 11 inside thereof, and a high pressure rotor shaft which has high pressure rotor blades 12 rooted thereto and which is disposed inside the high pressure inner casing 11. On the intermediate pressure side, like on the high pressure side, the steam turbine includes an intermediate pressure outer casing 20, an intermediate inner casing 21 inside thereof, and an intermediate pressure rotor shaft which has intermediate pressure rotor blades 22 rooted thereto and which is disposed inside the intermediate pressure inner casing 21. Incidentally, symbol 40 denotes a high/intermediate pressure integrated type rotor.

Both in the case of the high pressure steam turbine and in the case of the high/intermediate pressure integrated type steam turbine, a high-temperature high-pressure steam led to the steam turbine is obtained by use of a boiler, is passed through a main steam pipe and through a flange and an elbow 30 constituting a main steam inlet, and is led through a nozzle box 31 to first-stage rotor blades. Stator blades are provided correspondingly to the rotor blades, respectively.

In this embodiment, a cast steel of Sample No. 8 shown in Table 1 in Example 1 is used as material for the outer casing, the inner casing, and valve casings (a main steam stop valve casing and a governor valve casing). Fifty (50) tons of the steel is melted in an electric furnace and, after vacuum ladle refining, the melt is cast into a sand mold.

The cast steel thus obtained is subjected to a normalizing treatment by holding at 1050° C. for 10 min and cooling in furnace, is then subjected to a quenching (hardening) treatment by holding at 1050° C. and air blast cooling, and is then subjected twice to a tempering treatment by holding at 725° C. for 12 hr.

As a result of cutting and investigating these casings having a fully tempered bainite structure, they were found to sufficiently satisfy the characteristics required of the high-temperature (566° C.) high-pressure (24 MPa) casings (566° C.×100,000 hr strength≧98 MPa; FATT≦135° C.) and to be free of cracks upon a welding SR crack test.

The turbine casing or valve casing fabricated by use of the casing material as above-described is applicable to steam turbines used in high-temperature high-pressure steam environments.

What is claimed is:

1. A casing formed from an alloy containing, by mass, 0.08-0.20% C, 0.05-0.45% Si, 0.10-0.30% Mn, 0.80-1.40% Ni, 1.00-1.40% Cr, 1.20-1.60% Mo, 0.10-0.30% V, 0.06-0.10% Ti, 0.0005-0.0010% B, not more than 0.01% P, not more than 0.01% S, and 0.003-0.005% Al, the balance being Fe and unavoidable impurity elements; and wherein the content ratio of Mn/Ni is in the range of 0.07-0.32; and wherein the casing is used for a turbine.

2. The casing as set forth in claim 1, wherein the content ratio of (Mo+V)/Ni is in the range of 0.93-2.38.

3. The casing as set forth in claim 1, wherein the content ratio of (Mo+V)/Ni/B is in the range of 1000-5000.

4. A valve casing wherein the casing as set forth in claim 1 is used for a valve.

5. The casing as set forth in claim 1, wherein said alloy is a cast steel.

6. A casing formed from an alloy containing, by mass, 0.08-0.20% C, 0.05-0.45% Si, 0.10-0.30% Mn, 1.10-1.40% Ni, 1.00-1.40% Cr, 1.20-1.60% Mo, 0.10-0.30% V, 0.06-0.10% Ti, 0.0005-0.0010% B, not more than 0.01% P, not more than 0.01% S, and 0.003-0.005% Al, the balance being Fe and unavoidable impurity elements; and wherein the content ratio of Mn/Ni is in the range of 0.07-0.27; and wherein the casing is used for a turbine.

7. The casing as set forth in claim 6, wherein the content ratio of (Mo+V)/Ni is in the range of 0.93-1.73.

8. The casing as set forth in claim 6, wherein the content ratio of (Mo+V)/Ni/B is in the range of 3500-5000.

9. A valve casing wherein the casing as set forth in claim 6 is used for a valve.

10. The casing as set forth in claim 6, wherein said alloy is a cast steel.

11. A steam turbine wherein the casing as set forth in claim 1 is used.

12. A steam turbine wherein the valve casing as set forth in claim 4 is used.

13. A steam turbine wherein the casing as set forth in claim 6 is used.

14. A steam turbine wherein the valve casing as set forth in claim 9 is used.

15. A casing formed from an alloy containing, by mass, 0.05-0.25% C, 0.05-0.75% Si, 0.10-0.30% Mn, 0.80-1.40% Ni, 0.50-2.00% Cr, 0.05-2.00% Mo, 0.05-0.50% V, 0.06-0.15% Ti, 0.0003-0.0030% B, not more than 0.01% P, not more than 0.01% S, and 0.003-0.005% Al, the balance being Fe and unavoidable impurity elements, wherein the content ratio of Mn/Ni is in the range of 0.05-0.50, the content ratio of (Mo+V)/Ni is in the range of 0.71-3.16, and the content ratio of (Mo+V)/Ni/B is in the range of 200-5000.

* * * * *